US008820391B2

(12) United States Patent
Zanatta

(10) Patent No.: US 8,820,391 B2
(45) Date of Patent: Sep. 2, 2014

(54) BREATHER FOR PERMANENT ALUMINIUM-CASTING MOULD

(76) Inventor: Jeanlis Brito Zanatta, Jundiai (BR)

( * ) Notice: Subject to any disclaimer, the term of this patent is extended or adjusted under 35 U.S.C. 154(b) by 0 days.

(21) Appl. No.: 14/123,538

(22) PCT Filed: Jun. 8, 2011

(86) PCT No.: PCT/BR2011/000178

§ 371 (c)(1),
(2), (4) Date: Dec. 3, 2013

(87) PCT Pub. No.: WO2012/167335

PCT Pub. Date: Dec. 13, 2012

(65) Prior Publication Data

US 2014/0110078 A1 Apr. 24, 2014

(51) Int. Cl.
*B22C 9/06* (2006.01)
*B22C 7/06* (2006.01)

(52) U.S. Cl.
CPC ..... *B22C 9/067* (2013.01); *B22C 7/065* (2013.01); *Y10S 425/812* (2013.01)
USPC ..... 164/410; 164/305; 249/141; 425/812

(58) Field of Classification Search
CPC ..... B22C 9/067; B22C 7/065
USPC ..... 164/305, 410; 249/141; 425/812
See application file for complete search history.

(56) References Cited

U.S. PATENT DOCUMENTS

| | | | | |
|---|---|---|---|---|
| 2,789,326 | A * | 4/1957 | Krauss | 164/234 |
| 3,108,339 | A | 10/1963 | Bucy | |
| 3,188,701 | A * | 6/1965 | McIntyre | 164/410 |
| 4,946,363 | A * | 8/1990 | Cavender | 425/4 R |
| 6,827,569 | B2 * | 12/2004 | Wieder | 425/130 |

FOREIGN PATENT DOCUMENTS

| | | |
|---|---|---|
| BR | 7601176 | 7/1998 |
| BR | 8302786 | 7/2005 |

* cited by examiner

*Primary Examiner* — Keith Walker
*Assistant Examiner* — Kevin E Yoon
(74) *Attorney, Agent, or Firm* — Defillo & Associates, Inc.; Evelyn A. Defillo

(57) ABSTRACT

The patent relates to the field of metallurgical products and comprises a cylindrical body (15) provided with a plurality of slots (16), with a taper "A" designed such that the larger opening (18) is at the outer surface of the breather (15) and the smaller opening (19) is located internally with respect to the breather (15), so that the aluminum component (5), when removed from the mold (6), brings with it the burr (17), leaving the slots (16) of the breather (15) always free, and also a breather (20) comprising a cylindrical body constituted from a plurality of holes (21), with a conicity "A" designed such that the larger opening (22) is at the outer surface of the breather (20) and the smaller opening (23) is located internally with respect to the breather (20).

1 Claim, 5 Drawing Sheets

BREATHER FOR PERMANENT ALUMINIUM-CASTING MOULD

CROSS REFERENCE TO RELATED APPLICATION

This application is a national stage entry of PCT/BR2011/000178 filed Jun. 8, 2011, under the International Convention.

FIELD OF THE INVENTION

This specification of patent refers to a new vent, especially a device used in permanent moulds for casting of aluminium, innovative, and having important technological and functional design improvements, with the most modern engineering concepts and according to the required technical rules and specifications, having intrinsic characteristics, resulting in a number of real and extraordinary technical, practical and economic advantages.

BACKGROUND OF THE INVENTION

The production of aluminium castings using permanent moulds can have three types of metal pouring: with high pressure, by gravity, and with low pressure against gravity, wherein the latter two processes need vents for air outlet.

During the process of filling the mould, the molten metal tends to drag and trap the gases (air) that were present inside the cavity, taking them to the higher regions. This is a natural phenomenon in the casting process by gravity or by low pressure, and it has a tendency of formation of porosity in the part if these gases are not removed by mechanisms for air outlet, namely, vents, as shown in FIGS. 1 and 2.

Thus, the main function of vents is to allow discharge of air and other gases (from liquid metal), preventing at the same time the passage of aluminium, as shown in FIGS. 3 and 4.

As is known to those skilled in the art, after an early period of production the aluminium starts to penetrate in the holes of the vents, clogging the air outlets, therefore causing them to lose their function. The major effect of this scenario is the formation of defects due to porosity or the deformation of the part, compromising its quality and hence reducing the productivity of the castings, according to what is illustrated in FIG. 5.

Known Conventional Types of Vents—State of the Art

Currently, smelters work with three types of vents for permanent moulds; they are:

a) A machined vent with parallel grooves; it was the first type of vent developed for use in permanent moulds. It is manufactured in a simple design due the parallel grooves.

b) A sintered vent with parallel holes; this type of vent is manufactured with air outlets shaped like holes and not grooves, as the machined vents. However, these holes are parallel throughout the length of the vent.

c) A sintered vent with standard conical grooves; this type of vent has holes for exit of air designed like grooves, i.e., similar to the machined vents. In this type of vent the grooves have a small taper inside, instead a single dimension throughout its length (parallel grooves). What characterizes these conical grooves is the direction of the angle used in the constructive disposition: the smallest dimension is on the external face of the groove and it increases toward the interior of the vent.

Results Obtained From the Use of Conventional Vents of the Prior State of the Art At the time when the aluminum comes into contact with the vent during the mould filling stage, it is in liquid state at a temperature of 740° C. In this condition, the aluminium has fluidity and it can penetrate through the vent holes, causing their clogging with burrs.

The manner in which the smelters evaluate the effectiveness of a vent during the production of castings is related to the ability to maintain the air outlet free, for a greater number of parts produced; therefore, the longer the vents work without become clogged with aluminium, the greater its efficiency.

The resistance to aluminium clogging is analyzed in terms of the constructive arrangement of the holes in each type of vent. FIGS. 12 and 13 exemplify how the aluminium clogs the vent holes after a certain period of production.

Commonly, the smelters are forced to replace the clogged vents almost in a daily basis, because the aluminium difficults the simple cleaning of the holes. Thus, besides the loss of quality of their castings, the smelters are also penalized with higher costs due the consumption of vents with small lifetime. Another important aspect that contributes to the inefficiency of production are the losses summed with frequent stops of the machinery, in order to replace the damaged vents, since this is a work that requires a lot of runtime.

SUMMARY OF THE INVENTION

Having in mind the maximization of resistance to clogging, caused by penetration of aluminium, the unique and revolutionary vent was idealized, wherein it is able to provide technical advantages due the increase of quality of the castings and, at the same time, achieve higher productivity gains when compared with the three types of vent that define the prior state of art.

This increase in efficiency of the type of vent of the present invention is provided by the unique constructive arrangement of the grooves, which instead of presenting holes with parallel or inclined dimensions in a standard configuration, as exemplified above, are provided with an inverted inclination wherein the larger dimension is on the outer face of the vent, and not inside.

A type of vent with grooves or holes that difficult the pervasion of aluminium inside achieves the maximum performance efficiency desired by smelters. This technological evolution is reflected in the innovative constructive arrangement of the shape of the holes, due the dimensions of the outlet angle.

Another factor of great importance is the economic impact provided by this new type of vent, due the reduction of costs, since the manufacturing process—unlike the machining and sintering processes that predominate in the related art—allows achieve more competitive prices, and above all, in terms of reducing consumption, the new type has the unique advantage of reduction of the clogging frequency, with the direct benefit of a longer service life for the vents.

Importantly, the casting process used to manufacture this new type of vent offers two other technical advantages: the first concerns the possibility of making it both with holes shaped like grooves or with ordinary holes, wherein their shape has a inclination, in case of grooves, and a taper, in case of holes, both inverted with respect to the standard types known in prior state of art, and their dimensions can vary widely, always complying with the inverted inclination and/or taper. The second advantage lies in the dynamism and flexibility of this process, because it is possible manufacture the vent using several kinds of materials: carbon steel alloys, stainless steel alloy, brass alloys and bronze alloys.

BRIEF DESCRIPTION OF THE DRAWINGS

To complement this description, in order to obtain a better understanding of the characteristics of the invention, according to a preferred practical embodiment thereof, an set of accompanying drawings is attached here, exemplifying but not limiting the following.

DETAILED DESCRIPTION OF THE INVENTION

Figure 1:
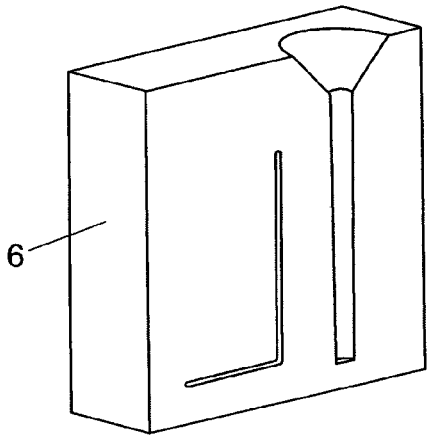
FIGS. 1 and 2 represent cross-sectional views of an example of a permanent mould having pouring by gravity, known in the prior art.
Figure 2:
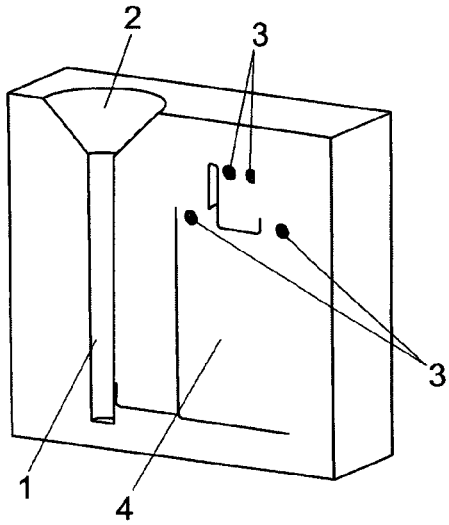
Figure 3:
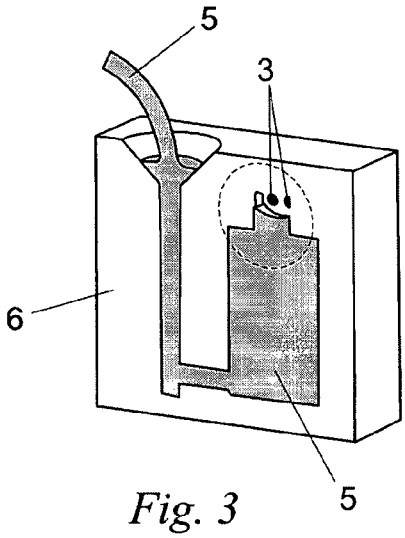
FIGS. 3 and 4 show a cross-sectional view of an example of a permanent mould having pouring by gravity and a detail of the location of the vents, respectively.
Figure 4:
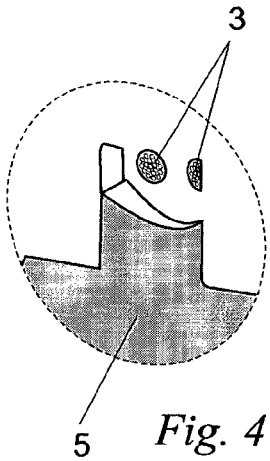
Figure 5:
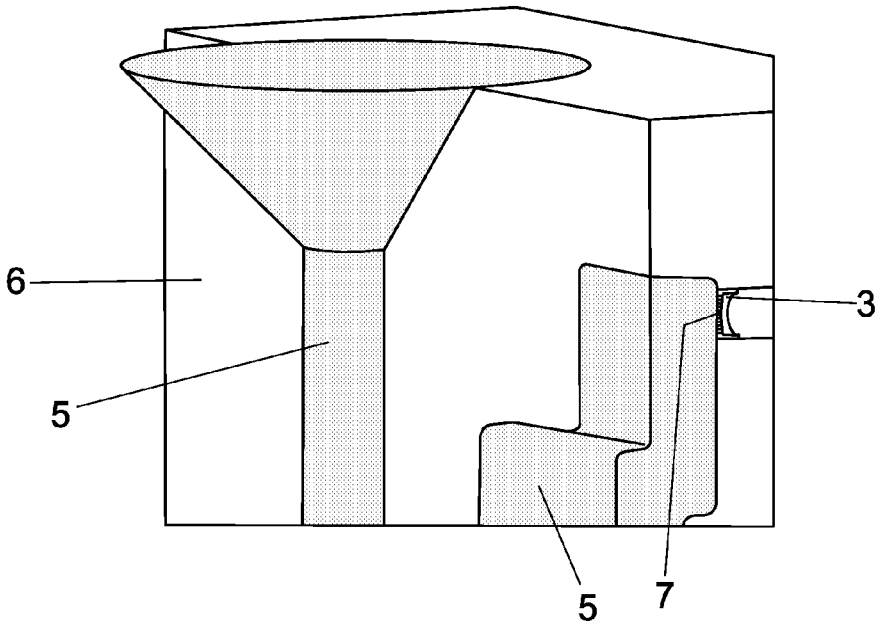
FIG. 5 is a cross-sectional view of a mould filled with aluminium.
Figure 6:
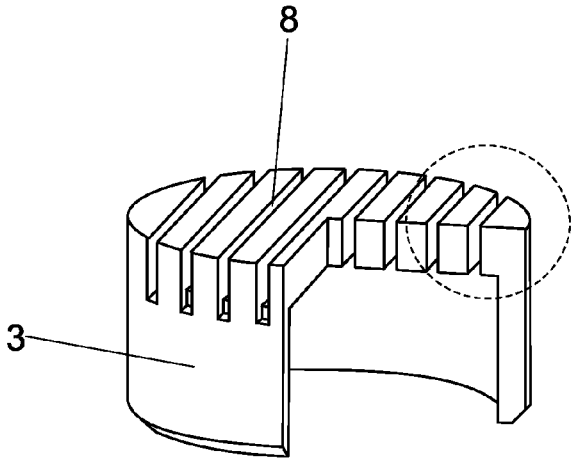
Fig. 6 PRIOR ART
FIGS. 6 and 7 show a type of machined vent having parallel grooves, known in the prior art.
Figure 7:
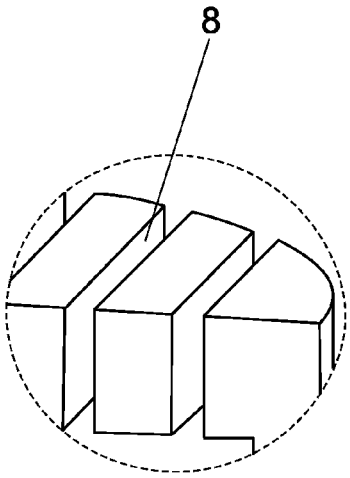
Fig. 7 PRIOR ART
Figure 8:
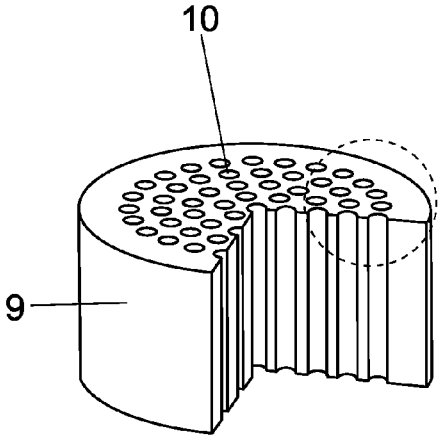
Fig. 8 PRIOR ART
FIGS. 8 and 9 show a model of sintered vent having parallel holes, known in the prior art.
Figure 9:
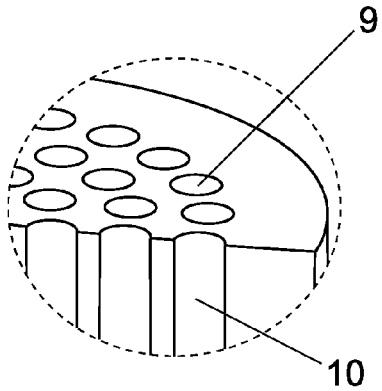
Fig. 9 PRIOR ART
Figure 10:
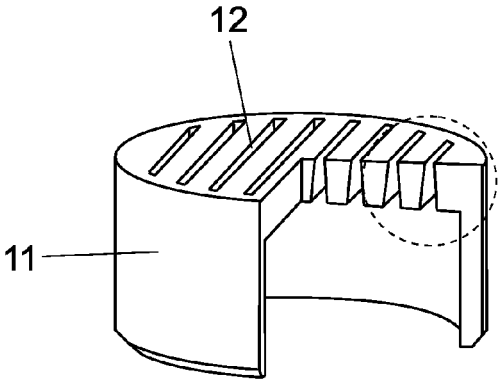
Fig. 10 PRIOR ART
FIGS. 10 and 11 show a type of standard sintered vent provided with inclined grooves, whose smaller dimension is on the outer side of the vent.
Figure 11:
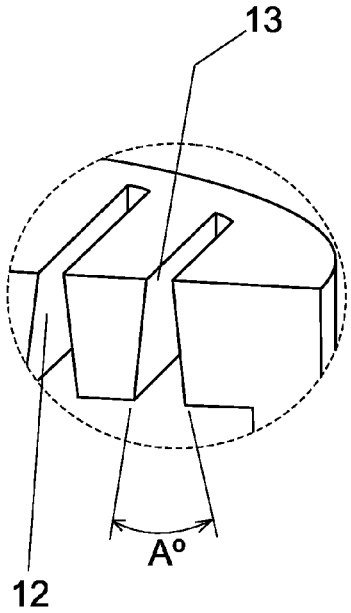
Fig. 11 PRIOR ART
Figure 12:
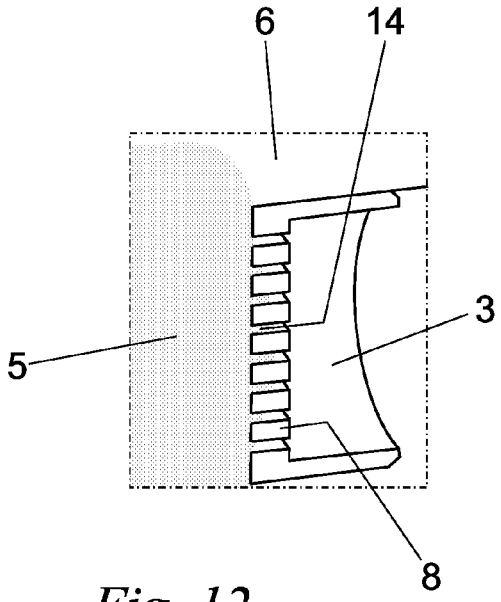
Fig. 12 PRIOR ART
FIG. 12 is a schematic view of the moment when the aluminium clogs the vent, penetrating into the grooves.
Figure 13:
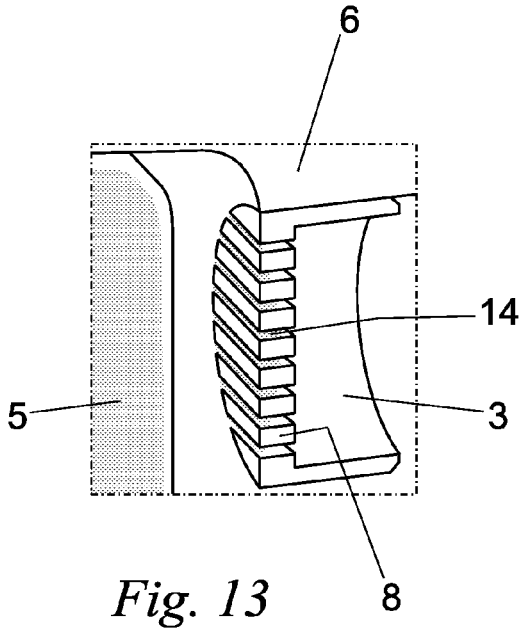
Fig. 13 PRIOR ART
FIG. 13 is a schematic view of the moment when the aluminium part is removed, leaving burrs in the vent grooves and clogging the vent.
Figure 14:
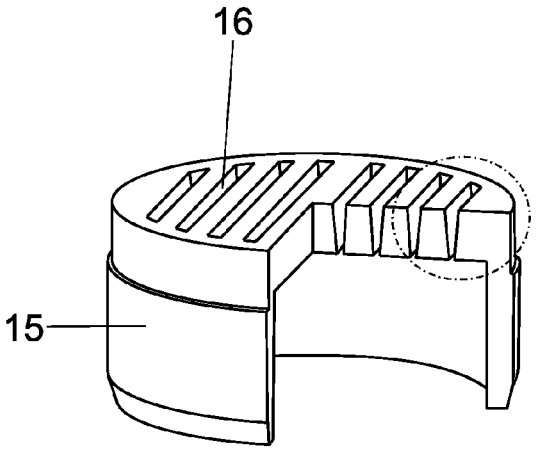
FIGS. 14 and 15 show cross-sectional perspective views of the vent of the present invention, provided with inclined grooves, whose larger dimension is on the outer face of the vent.
Figure 15:
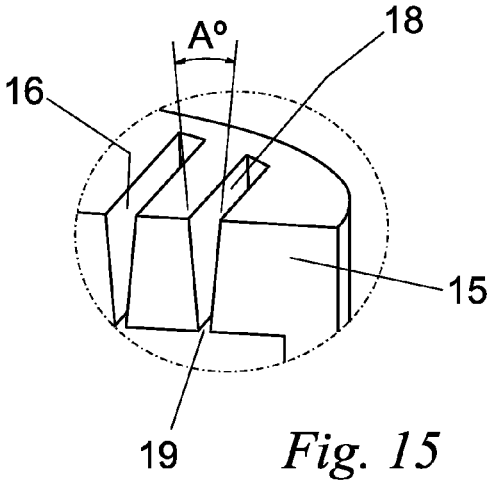
Figure 16:
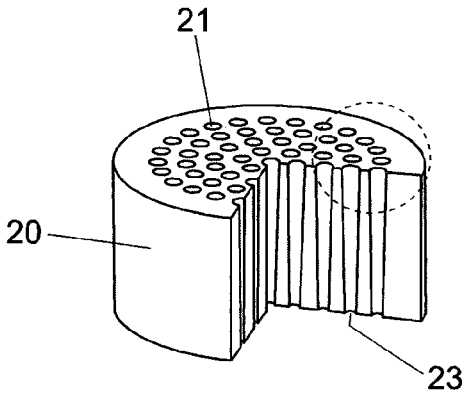
FIGS. 16 and 17 show cross-sectional perspective views of the vent of the present invention, provided with tapered holes, whose larger dimension is on the outer face of the vent.
Figure 17:
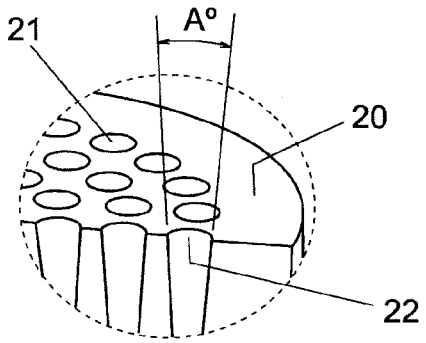
Figure 18:
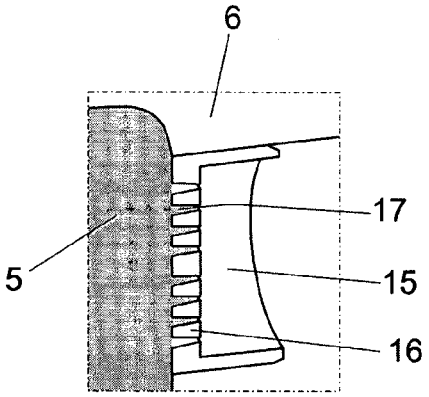
FIG. 18 is a schematic view of the moment when the aluminium comes into contact with the vent grooves of the present invention, penetrating the grooves.
Figure 19:
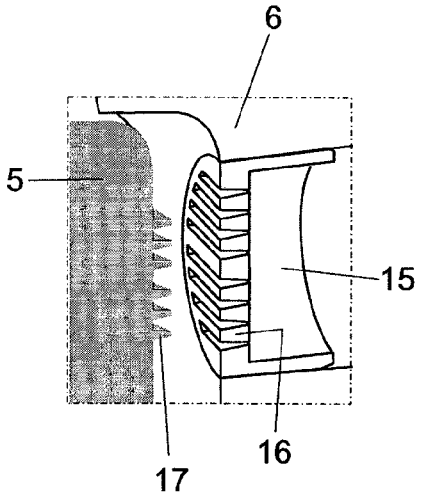
FIG. 19 is a schematic view of the moment when the aluminium part is removed together with burrs, leaving free the grooves of the vent of the present invention.

According to the figures and their details, the example of permanent mould (6) having pouring by gravity consists of a pouring basin (2) connected to a filling channel (1) connected to a cavity (4) whose top is provided with vents (3) for air outlet.

To the extent that the aluminium (5) is poured into the mould (6) filling the cavity (4), at the end of the operation the aluminium comes into contact with the outer face (7) of the vent (3).

The vent (3) is known in the prior art and is manufactured with parallel grooves (8).

The vent (9) is known in the prior art and is manufactured with parallel channels (10).

The vent (11) is known in the prior art and is manufactured with standard inclined grooves (12), so that the smaller dimension (13) is on the outer surface of the vent (11), where the angle A indicates the direction of inclination.

The vent (3) installed on the mould (6), at the time the aluminium clogs said vent (3) known in the prior art, penetrating in the grooves (8), is an example of inefficiency of said vent (3), since the burr (14) of the aluminium part (5) clogs the grooves (8) causing their jamming.

The vent (15) of the present invention is comprised of a cylindrical body to die (6) and consists of a plurality of grooves (16) having an inclination "A", so that the larger opening (18) is on the external surface of the vent (15) and the smaller opening (19) is inside of said vent (15), so that when the aluminium part (5) is removed from the mould (6) said part carries the burr (17), leaving the grooves (16) of the vent (15) always clean and free.

The vent (20) of the present invention is also comprised of a cylindrical body provided with a plurality of holes (21) having a taper "A", so that the larger opening (22) is on the external surface of the vent (20) and the smaller opening (23) is inside of the vent (20).

There is no known type of vent for permanent mould, for aluminium casting, gathering all the constructive and functional characteristics above disclosed, and that is directly or indirectly so effective as the vent of the present invention.

It will be apparent to those skilled in the art that while the preferred embodiment describes the constructive arrangement introduced in this object of invention, any modifications and/or changes must be understood as within its scope, fitting perfectly on the criteria that define the invention, i.e., the combination and modification of already known elements in a new form or arrangement that result in functional improvement in its use or its manufacturing.

The invention claimed is:

1. A mould having a vent, wherein the vent comprises:

a cylindrical body provided with a plurality of grooves (16) having an inclination A, with a larger section of the groove (18) located on an external surface of the vent (15) and a smaller section of the groove (19) located inside of said vent (15), so that when an aluminium part (5) is removed from the cylindrical body said aluminum part carries a burr (17), leaving the grooves (16) of the vent (15) always clean and free;

or a cylindrical body provided with a plurality of holes (21) having a taper with a larger section of the hole (22) located on an external surface of the vent (20) and a smaller section of the hole (23) is located inside of the vent (20).

* * * * *